United States Patent [19]

Fukuda et al.

[11] Patent Number: 4,601,801

[45] Date of Patent: Jul. 22, 1986

[54] VERTICAL TYPE ELECTRO-GALVANIZING APPARATUS

[75] Inventors: Shuzo Fukuda; Yutaka Ohkubo; Toshio Ishii; Masaru Sagiyama, all of Yokohama; Akira Tonouchi, Tokyo, all of Japan

[73] Assignee: Nippon Kokan Kabushiki Kaisha, Tokyo, Japan

[21] Appl. No.: 753,223

[22] Filed: Jul. 9, 1985

[30] Foreign Application Priority Data

Jul. 31, 1984 [JP] Japan ..... 59-159087

[51] Int. Cl.[4] ..... C25D 17/00

[52] U.S. Cl. ..... 204/206

[58] Field of Search ..... 204/206-211

[56] References Cited

U.S. PATENT DOCUMENTS

| | | | |
|---|---|---|---|
| 2,317,242 | 4/1943 | Allen | 204/206 |
| 2,535,966 | 12/1950 | Teplitz | 204/206 |
| 2,554,943 | 5/1951 | Farmer | 204/206 |
| 4,118,302 | 10/1978 | Gobert | 204/206 |
| 4,132,609 | 1/1979 | Bush | 204/206 |
| 4,434,040 | 2/1984 | Brendlinger | 204/206 |
| 4,526,668 | 7/1985 | Podrini | 204/206 |

OTHER PUBLICATIONS

Iron and Steel Handbook (Tekko-Binran), vol. IV, Published on May 31, 1982 in Japan.

*Primary Examiner*—T. M. Tufariello

*Attorney, Agent, or Firm*—Frishauf, Holtz, Goodman & Woodward

[57] ABSTRACT

A vertical type electro-galvanizing apparatus, which comprises: a U-shaped electro-galvanizing tank including a first vertical path (12) at a steel strip inlet side, a second vertical path (13) at a steel strip outlet side and a horizontal path (14) for communicating the lower end of the first vertical path (12) to the lower end of the second vertical path (13); a first conductor roll (2), arranged above the first vertical path (12), for directing a steel strip (5) downwardly into the first vertical path (12) and applying electricity to the steel strip (5); at least one sink roll (3, 3'), arranged in the horizontal path (14), for upwardly reversing the travelling direction of the steel strip (5); a second conductor roll (4), arranged above the second vertical path (13), for directing the steel strip (5) upwardly from the second vertical path (13) and applying electricity to the steel strip (5); at least one first electrode plate (6, 6) arranged in the first vertical path (12); at least one second electrode plate (7, 7) arranged in the second vertical path (13); an electro-galvanizing solution supply pipe (17) arranged at a top portion (15) of the first vertical path (12) and/or a top portion (16) of the second vertical path (13); and at least one electro-galvanizing bath discharge pipe (18) arranged at the top portion (15) of the first vertical path (12) and/or the top portion (16) of the second vertical path (13).

3 Claims, 5 Drawing Figures

VERTICAL TYPE ELECTRO-GALVANIZING APPARATUS

REFERENCE TO PATENTS, APPLICATIONS AND PUBLICATIONS PERTINENT TO THE INVENTION

As far as we know, the prior art document pertinent to the present invention is: "Iron and Steel Handbook" (Tekko-Binran), Vol. IV, published on May 31, 1982 in Japan.

The contents of the prior art disclosed in the above-mentioned prior art document will be discussed hereafter under the heading of the "BACKGROUND OF THE INVENTION".

FIELD OF THE INVENTION

The present invention relates to a vertical type electro-galvanizing apparatus which directs a steel strip into a vertical type electro-galvanizing tank, and electro-galvanizes at least one of the surfaces of the steel strip by means of electrode plates arranged vertically in the electro-galvanizing tank.

BACKGROUND OF THE INVENTION

Automobile and other manufacturers are strongly demanding an electro-galvanized steel strip or an electro-zinc-alloy-galvanized steel strip (hereinafter generally referred to as "electro-galvanized steel strip") having a coating uniform in the chemical composition and thickness and having an excellent appearance.

The following electro-galvanizing apparatuses are known for electro-galvanizing at least one of the surfaces of a steel strip with zinc or electro-zinc-alloy-galvanizing at least one of the surfaces of a steel strip with alloy comprising zinc and at least one of iron, nickel, cobalt, chromium and other metals (hereinafter generally referred to as "electro-galvanizing"):

(1) a horizontal type electro-galvanizing apparatus comprising a horizontal type electro-galvanizing tank for receiving an electro-galvanizing bath and at least one electrode plate arranged in said electro-galvanizing tank substantially in parallel with a steel strip horizontally travelling through said electro-galvanizing tank, and (2) a vertical type electro-galvanizing apparatus comprising a vertical type electro-galvanizing tank for receiving an electro-galvanizing bath, at least one first electrode plate and at least one second electrode plate arranged in said electro-galvanizing tank substantially in parallel with a steel strip vertically travelling down and then up through said electro-galvanizing tank.

As compared with the horizontal type electro-galvanizing apparatus, the vertical type electro-galvanizing apparatus has the following advantages:

(1) In the horizontal type electro-galvanizing apparatus, wavy irregularities are produced in the steel strip during travelling through the horizontal type electro-galvanizing tank, and as a result, there occur variations in the distance between the steel strip and the at least one electrode plate, thus resulting in non-uniform thickness of the coating. In addition, contact of the steel strip with the at least one electrode plate may cause damages to the steel strip. In the vertical type electro-galvanizing apparatus, in contrast, no wavy irregularities occur in the steel strip during travelling through the vertical type electro-galvanizing tank, thus permitting manufacture of an electro-galvanized steel strip free from damage, with a uniform thickness of the coating.

(2) The vertical type electro-galvanizing apparatus requires only a small site area for installation.

As a vertical type electro-galvanizing apparatus, an apparatus is disclosed in the publication entitled "Iron and Steel Handbook" (Tekko-Binran), Vol. IV, published on May 31, 1982 in Japan, which comprises:

a vertical type electro-galvanizing tank for receiving an electro-galvanizing bath; a first conductor roll, arranged above a steel strip inlet side of said electro-galvanizing tank, for substantially vertically directing a steel strip downwardly into said electro-galvanizing tank and applying electricity to said steel strip; a sink roll, arranged in said electro-galvanizing tank, for upwardly reversing the travelling direction of said steel strip directed into said electro-galvanizing tank; a second conductor roll, arranged above a steel strip outlet side of said electro-galvanizing tank, for substantially vertically directing said steel strip upwardly from said electro-galvanizing tank and applying electricity to said steel strip; a pair of first electrode plates for electro-galvanizing the both surfaces of said steel strip, which are arranged in said electro-galvanizing tank between said first conductor roll and said sink roll substantially in parallel with said steel strip travelling downwardly through said electro-galvanizing tank with said steel strip therebetween; a pair of second electrode plates for electro-galvanizing the both surfaces of said steel strip, which are arranged in said electro-galvanizing tank between said sink roll and said second conductor roll substantially in parallel with said steel strip travelling upwardly through said electro-galvanizing tank with said steel strip therebetween; an electro-galvanizing solution supply means for supplying an electro-galvanizing solution into said electro-galvanizing tank to form an electro-galvanizing bath therein, and forming a flow at a prescribed flow velocity of said electro-galvanizing bath between said pair of first electrode plates and said steel strip travelling downwardly and between said pair of second electrode plates and said steel strip travelling upwardly; and an electro-galvanizing bath discharge means, provided at a top portion of said electro-galvanizing tank, for causing overflow of said electro-galvanizing bath in said electro-galvanizing tank (hereinafter referred to as the "prior art").

FIG. 5 is a schematic longitudinal sectional view of the above-mentioned apparatus of the prior art. As shown in FIG. 5, a first conductor roll 2 for substantially vertically directing a steel strip 5 downwardly into a vertical type electro-galvanizing tank 1 and applying electricity to the steel strip 5 is arranged above a steel strip inlet side of the electro-galvanizing tank 1. A sink roll 3 for upwardly reversing the travelling direction of the steel strip 5 directed into the electro-galvanizing tank 1 is arranged in the lower portion of the electro-galvanizing tank 1. A second conductor roll 4 for substantially vertically directing the steel strip 5 upwardly from the electro-galvanizing tank 1 and applying electricity to the steel strip 5 is arranged above a steel strip outlet side of the electro-galvanizing tank 1.

A pair of first electrode plates 6, 6 and a pair of second electrode plates 7, 7 for electro-galvanizing the both surfaces of the steel strip 5 are arranged in the electro-galvanizing tank 1. The pair of first electrode plates 6, 6 are arranged between the first conductor roll 2 and the sink roll 3 substantially in parallel with the steel strip 5 travelling downwardly through the electro-galvanizing tank 1 with the steel strip 5 therebetween. The pair of second electrode plates 7, 7 are arranged between the sink roll 3 and the second conductor roll 4 substantially in parallel with the steel strip 5 travelling upwardly through the electro-galvanizing tank 1 with the steel strip 5 therebetween.

A pair of first nozzles 8, 8 and a pair of second nozzles 9, 9 for supplying an electro-galvanizing solution into the electro-galvanizing tank 1 to form an electro-galvanizing bath therein are arranged in the lower portion of the electro-galvanizing tank 1. The pair of first nozzles 8, 8 are upwardly arranged respectively below each of the pair of first electrode plates 6, 6 near the lower ends thereof so as to form a rising flow of electro-galvanizing bath at a prescribed flow velocity between each of the pair of first electrode plates 6, 6 and the steel strip 5 travelling downwardly. The pair of second nozzles 9, 9 are upwardly arranged respectively below each of the pair of second electrode plates 7, 7 near the lower ends thereof so as to form a rising flow of electro-galvanizing bath at a prescribed flow velocity between each of the pair of second electrode plates 7, 7 and the steel strip travelling upwardly. An electro-galvanizing bath discharge pipe 10 for causing overflow of the electro-galvanizing bath in the electro-galvanizing tank 1 is provided at a top portion 1*a* of the electro-galvanizing tank 1.

Electro-galvanizing solution ejected into the electro-galvanizing bath from each of the pair of first nozzles 8, 8 and the pair of second nozzles 9, 9 rises between each of the pair of first electrode plates 6, 6 and the steel strip 5 travelling downwardly, and between each of the pair of second electrode plates 7, 7 and the steel strip 5 travelling upwardly, and overflows through the electro-galvanizing bath discharge pipe 10. The steel strip 5 travels downwardly and then upwardly in the electro-galvanizing tank 1 through the first conductor roll 2, the sink roll 3 and the second conductor roll 4, and the both surfaces of the steel strip 5 are electro-galvanized while the steel strip 5 passes between the pair of first electrode plates 6, 6 and between the pair of second electrode plates 7, 7.

The above-mentioned apparatus of the prior art has the following problem: The flow velocity of electro-galvanizing bath which rises between the pair of first electrode plates 6, 6 and the steel strip 5 travelling downwardly and between the pair of second electrode plates 7, 7 and the steel strip 5 travelling upwardly, is reduced as the distance from the pair of first nozzles 8, 8 and the pair of second nozzles 9, 9 becomes longer, resulting in a non-uniform flow velocity of the electro-galvanizing bath. When the flow velocity of the electro-galvanizing bath rising between the pair of first electrode plates 6, 6 and the steel strip 5 travelling downwardly and between the pair of second electrode plates 7, 7 and the steel strip 5 travelling upwardly becomes non-uniform, irregularities are produced on the surfaces of the coatings formed on the surfaces of the steel strip 5, and particularly when the coating is a zinc alloy coating such as an iron-zinc alloy coating, there occur variations in the chemical composition of the zinc alloy coating.

A problem similar to that mentioned above is also encountered when arranging the pair of first nozzles 8, 8 and the pair of second nozzles 9, 9 above the pair of first electrode plates 6, 6 and the pair of second electrode plates 7, 7 to form downward flows of electro-galvanizing bath respectively between the pair of first electrode plates 6, 6 and the steel strip 5 travelling downwardly and between the pair of second electrode plates 7, 7 and the steel strip 5 travelling upwardly, or when arranging the pair of first nozzles 8, 8 and the pair of second nozzles 9, 9 on the sides of the pair of first electrode plates 6, 6 and the pair of second electrode plates 7, 7 to form flows of electro-galvanizing bath in the width direction of the steel strip 5 respectively between the pair of first electrode plates 6, 6 and the steel strip 5 travelling downwardly and between the pair of second electrode plates 7, 7 and the steel strip 5 travelling upwardly.

Under such circumstances, there is a strong demand for the development of a vertical type electro-galvanizing apparatus which can ensure a uniform flow velocity of an electro-galvanizing bath flowing respectively between at least one first electrode plate arranged in a vertical type electro-galvanizing tank and a steel strip travelling through the tank and between at least one second electrode plate arranged also in the tank and the steel strip to form a coating free from irregularities and having a uniform chemical composition on at least one of the surfaces of the steel strip, but such an apparatus has not as yet been proposed.

SUMMARY OF THE INVENTION

An object of the present invention is therefore to provide a vertical type electro-galvanizing apparatus which can ensure a uniform flow velocity of an electro-galvanizing bath flowing respectively between at least one first electrode plate arranged in a vertical type electro-galvanizing tank and a steel strip travelling through the tank and between at least one second electrode plate arranged also in the tank and the steel strip to form a coating free from irregularities and having a uniform chemical composition on at least one of the surfaces of the steel strip.

In accordance with one of the features of the present invention, there is provided a vertical type electro-galvanizing apparatus, which comprises:

a vertical type electro-galvanizing tank for receiving an electro-galvanizing bath;

a first conductor roll, arranged above a steel strip inlet side of said electro-galvanizing tank, for substantially vertically directing a steel strip downwardly into said electro-galvanizing tank and applying electricity to said steel strip;

at least one sink roll, arranged in said electro-galvanizing tank, for upwardly reversing the travelling direction of said steel strip directed into said electro-galvanizing tank;

a second conductor roll, arranged above a steel strip outlet side of said electro-galvanizing tank, for substantially vertically directing said steel strip upwardly from said electro-galvanizing tank and applying electricity to said steel strip;

at least one first electrode plate for electro-galvanizing at least one of the surfaces of said steel strip, which is arranged in said electro-galvanizing tank between said first conductor roll and said at least one sink roll substantially in parallel with said steel strip travelling downwardly through said electro-galvanizing tank;

at least one second electrode plate for electro-galvanizing at least one of the surfaces of said steel strip, which is arranged in said electro-galvanizing tank between said at least one sink roll and said second conductor roll substantially in parallel with said steel strip travelling upwardly through said electro-galvanizing tank;

an electro-galvanizing solution supply means for supplying an electro-galvanizing solution into said electro-galvanizing tank to form an electro-galvanizing bath therein, and forming a flow at a prescribed flow velocity of said electro-galvanizing bath between said at least one first electrode plate and said steel strip travelling downwardly and between said at least one second electrode plate and said steel strip travelling upwardly; and at least one electro-galvanizing bath discharge means, provided at a top portion of said electro-galvanizing tank, for causing overflow of said electro-galvanizing bath in said electro-galvanizing tank;

characterized in that:

said vertical type electro-galvanizing tank (11) comprises a U-shaped electro-galvanizing tank including a first vertical path (12) at a steel strip inlet side, a second vertical path (13) at a steel strip outlet side and a horizontal path (14) for communicating the lower end of said first vertical path (12) with the lower end of said second vertical path (13), said first vertical path (12) and said second vertical path (13) having the same cross-sectional area, said steel strip (5) passing sequentially through said first vertical path (12), said horizontal path (14) and said second vertical path (13);

said first conductor roll (2) is arranged above said first vertical path (12);

said at least one sink roll (3, 3') is arranged in said horizontal path (14);

said second conductor roll (4) is arranged above said second vertical path (13);

said at least one first electrode plate (6, 6) is arranged in said first vertical path (12) substantially in parallel with said steel strip (5) travelling downwardly through said first vertical path (12);

said at least one second electrode plate (7, 7) is arranged in said second vertical path (13) substantially in parallel with said steel strip (5) travelling upwardly through said second vertical path (13);

said electro-galvanizing solution supply means comprises an electro-galvanizing solution supply pipe (17) arranged at at least one of a top portion (15) of said first vertical path (12) and a top portion (16) of said second vertical path (13), the lower portion of said electro-galvanizing solution supply pipe (17) being immersed into said electro-galvanizing bath in at least one of said top portions (15, 16) during operation; and said at least one electro-galvanizing bath discharge means comprises at least one electro-galvanizing bath discharge pipe (18) arranged at at least one of said top portion (15) of said first vertical path (12) and said top portion (16) of said second vertical path (13).

DETAILED DESCRIPTION OF PREFERRED EMBODIMENTS

From the above-mentioned point of view, we carried out extensive studies to develop a vertical type electro-galvanizing apparatus which can ensure a uniform flow velocity of electro-galvanizing bath flowing between at least one first electrode plate arranged in a vertical type electro-galvanizing tank and a steel strip travelling through the tank and between at least one second electrode plate arranged also in the tank and the steel strip to form a coating free from irregularities and having a uniform chemical composition on at least one of the surfaces of the steel strip.

As a result, we obtained the following finding: By using a U-shaped electro-galvanizing tank which comprises a first vertical path at a steel strip inlet side, a second vertical path at a steel strip outlet side having the same cross-sectional area as that of the first vertical path, and a horizontal path for communicating the lower end of the first vertical path with the lower end of the second vertical path; vertically arranging at least one first electrode plate in the first vertical path and at least one second electrode plate in the second vertical path; forming a flow of an electro-galvanizing bath from the second vertical path through the horizontal path toward the first vertical path or from the first vertical path through the horizontal path toward the second vertical path; and passing a steel strip sequentially through the first vertical path, the horizontal path and the second vertical path; it is possible to ensure a uniform flow velocity of the electro-galvanizing bath flowing respectively between the at least one first electrode plate and the steel strip and between the at least one second electrode plate and the steel strip to form a coating free from irregularities and having a uniform chemical composition on at least one of the surfaces of the steel strip.

The present invention was made on the basis of the above-mentioned finding. Now, the vertical type electro-galvanizing apparatus of the present invention is described with reference to drawings.

Figure 1:
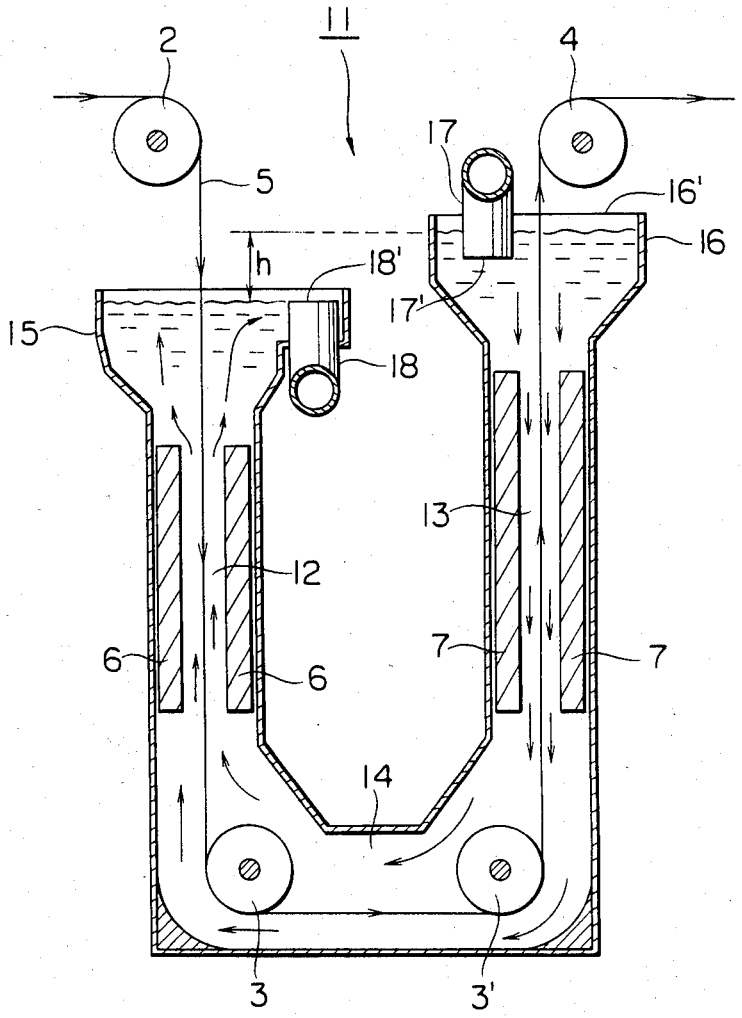
FIG. 1 is a schematic longitudinal sectional view illustrating a first embodiment of the apparatus of the present invention.
Figure 2:
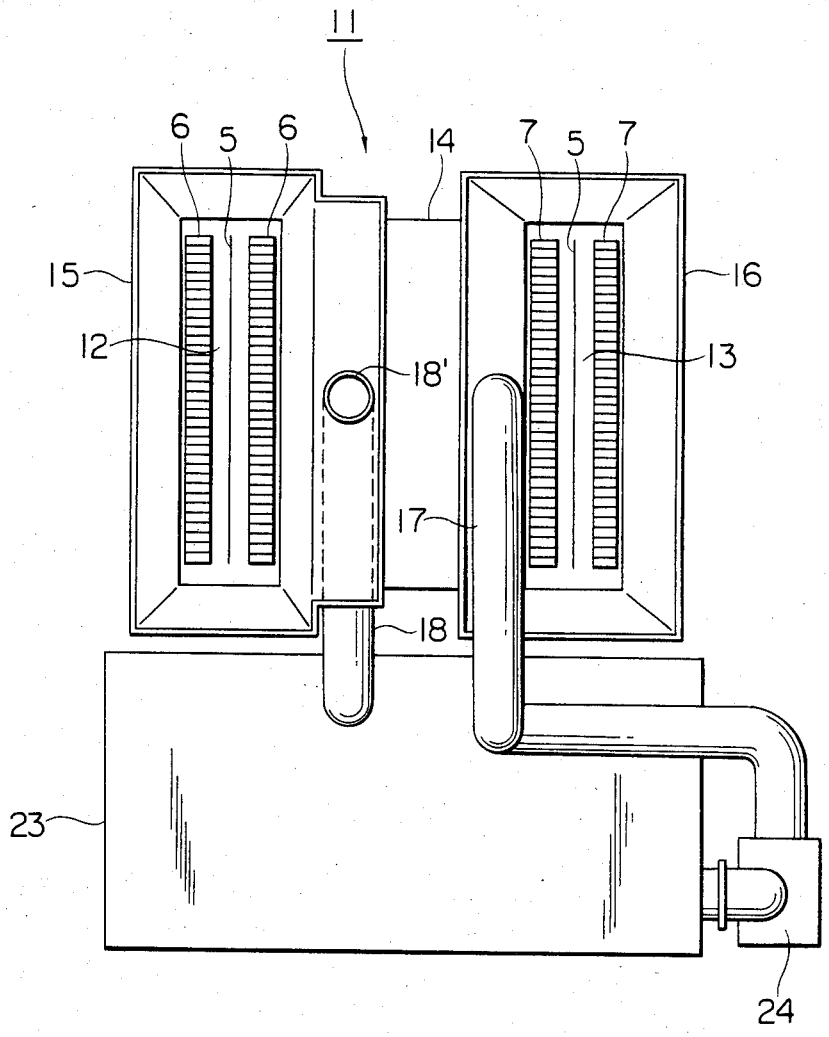
FIG. 2 is a schematic plan view illustrating the apparatus of the first embodiment of the present invention shown in FIG. 1.

FIG. 1 is a schematic longitudinal sectional view illustrating a first embodiment of the apparatus of the present invention, and FIG. 2 is a schematic plan view illustrating the apparatus of the first embodiment of the present invention shown in FIG. 1. As shown in FIGS. 1 and 2, a vertical type electro-galvanizing tank 11 for receiving an electro-galvanizing bath comprises a U-shaped electro-galvanizing tank including a first vertical path 12 having a rectangular cross section at a steel strip inlet side, a second vertical path 13 having a rectangular cross section at a steel strip outlet side, and a horizontal path 14 having a rectangular cross section for communicating the lower and of the first vertical path 12 with the lower end of the second vertical path 13. The first vertical path 12 and the second vertical path 13 have the same cross-sectional area. The top portion 15 of the first vertical path 12 has a cross-sectional area larger than that of the other portion of the first vertical path 12, and the top portion 16 of the second vertical path 13 has a cross-sectional area larger than that of the other portion of the second vertical path 13.

A first conductor roll 2 for substantially vertically directing a steel strip 5 downwardly into the vertical path 12 and applying electricity to the steel strip 5 is arranged above the first vertical path 12. Two sink rolls 3 and 3'for upwardly reversing the travelling direction of the steel strip 5 substantially vertically directed downwardly into the first vertical path 12 and directing the steel strip 5 into the second vertical path 13 are arranged in the horizontal path 14. A second conductor roll 4 for substantially vertically directing the steel strip 5 directed into the second vertical path 13 upwardly from the second vertical path 13 and applying electricity to the steel strip 5 is arranged above the second vertical path 13. The steel strip 5 passes sequentially through the first vertical path 12, the horizontal path 14 and the second vertical path 13 by means of the first conductor roll 2, the two sink rolls 3 and 3' and the second conductor roll 4.

A pair of first electrode plates 6, 6 for electro-galvanizing the both surfaces of the steel strip 5 are arranged in the first vertical path 12 below the top portion 15 thereof substantially in parallel with the steel strip 5 travelling downwardly through the first vertical path 12 with the steel strip 5 therebetween. A pair of second electrode plates 7, 7 for electro-galvanizing the both surfaces of the steel strip 5 are arranged in the second vertical path 13 below the top portion 16 thereof substantially in parallel with the steel strip 5 travelling upwardly through the second vertical path 13 with the steel strip 5 therebetween.

An electro-galvanizing solution supply pipe 17 for supplying an electro-galvanizing solution into the electro-galvanizing tank 11 to form an electro-galvanizing bath therein is arranged at the top portion 16 of the second vertical path 13. The electro-galvanizing solution supply pipe 17 has an opening end 17' thereof in the top portion 16 of the second vertical path 13, and the lower portion of the electro-galvanizing solution supply pipe 17 is immersed into the electro-galvanizing bath in the top portion 16 during operation.

An electro-galvanizing bath discharge pipe 18 for causing overflow of the electro-galvanizing bath in the electro-galvanizing tank 11 is arranged at the top portion 15 of the first vertical path 12. The electro-galvanizing bath discharge pipe 18 has an opening end 18' thereof in the top portion 15 of the first vertical path 12. The opening end 18' of the electro-galvanizing bath discharge pipe 18 is lower in position than the uppermost end 16' of the second vertical path so that a prescribed head "h" is produced between the electro-galvanizing bath level in the top portion 16 of the second vertical path 13 and the electro-galvanizing bath level in the top portion 15 of the first vertical path 12.

In FIG. 2, 23 is a tank for receiving electro-galvanizing solution and supplying same through the electro-galvanizing solution supply pipe 17 into the top portion 16 of the second vertical path 13. Electro-galvanizing solution received in the tank 23 is supplied by a pump 24 through the electro-galvanizing solution supply pipe 17 into the top portion 16 of the second vertical path 13. On the other hand, the other end of the electro-galvanizing bath discharge pipe 18 having the opening end 18' thereof in the top portion 15 of the first vertical path 12 is connected to the tank 23, and the electro-galvanizing bath overflowing through the electro-galvanizing bath discharge pipe 18 is returned into the tank 23.

The electro-galvanizing bath in the electro-galvanizing tank 11 flows sequentially through the second vertical path 13, the horizontal path 14 and the first vertical path 12 under the effect of the head "h" between the electro-galvanizing bath level in the top portion 16 of the second vertical path 13 and the electro-galvanizing bath level in the top portion 15 of the first vertical path 12, and overflows through the electro-galvanizing bath discharge pipe 18. On the other hand, the steel strip 5 travels, against the above-mentioned flow of the electro-galvanizing bath, sequentially through the first vertical path 12, the horizontal path 14 and the second vertical path 13 by means of the first conductor roll 2, the two sink rolls 3 and 3' and the second conductor roll 4, and the both surfaces of the steel strip 5 are electro-galvanized while passing between the pair of first electrode plates 6, 6 arranged in the first vertical path 12 and between the pair of second electrode plates 7, 7 arranged in the second vertical path 13.

As described above, the electro-galvanizing bath flows sequentially through the second vertical path 13, the horizontal path 14 and the first vertical path 12 under the effect of the head "h" between the electro-galvanizing bath level in the top portion 16 of the second vertical path 13 and the electro-galvanizing bath level in the top portion 15 of the first vertical path 12, and the first vertical path 12 and the second vertical path 13 have the same cross-sectional area. The electro-galvanizing bath therefore flows at a uniform flow velocity between the pair of second electrode plates 7, 7 arranged in the second vertical path 13 and the steel strip 5 travelling upwardly and between the pair of first electrode plates 6, 6 arranged in the first vertical path 12 and the steel strip 5 travelling downwardly. It is thus possible to form a coating free from irregularities and having a uniform chemical composition on the both surfaces of the steel strip 5.

It is possible to control the flow velocity of the electro-galvanizing bath flowing sequentially through the second vertical path 13, the horizontal path 14 and the first vertical path 12 by adjusting the amount of the electro-galvanizing solution supplied into the top portion 16 of the second vertical path 13 through the electro-galvanizing solution supply pipe 17 to control the head "h" between the electro-galvanizing bath level in the top portion 16 of the second vertical path 13 and the electro-galvanizing bath level in the top portion 15 of the first vertical path 12.

As described above, the opening end 17' of the electro-galvanizing solution supply pipe 17 is arranged in the top portion 16 having a cross-sectional area larger than the cross-sectional area of the other portion of the second vertical path 13. Therefore, the flow velocity of the electro-galvanizing bath flowing sequentially through the second vertical path 13, the horizontal path 14 and the first vertical path 12 is less susceptible to the influence of the flow velocity of electro-galvanizing solution immediately after being supplied through the electro-galvanizing solution supply pipe 17 into the top portion 16 of the second vertical path 13. A substantially horizontal current plate (not shown) may be provided below the opening end 17' of the electro-galvanizing solution supply pipe 17 in the top portion 16 of the second vertical path 13, in order to prevent the above-mentioned influence of the flow velocity of electro-galvanizing solution immediately after being supplied into the top portion 16 of the second vertical path 13.

Several vertical type electro-galvanizing apparatuses having a structure as described above of the present invention may be installed in series at prescribed intervals, wherein the coatings are formed on the both surfaces of the steel strip 5, while the steel strip 5 sequentially passes through these several electro-galvanizing apparatuses.

Figure 3:
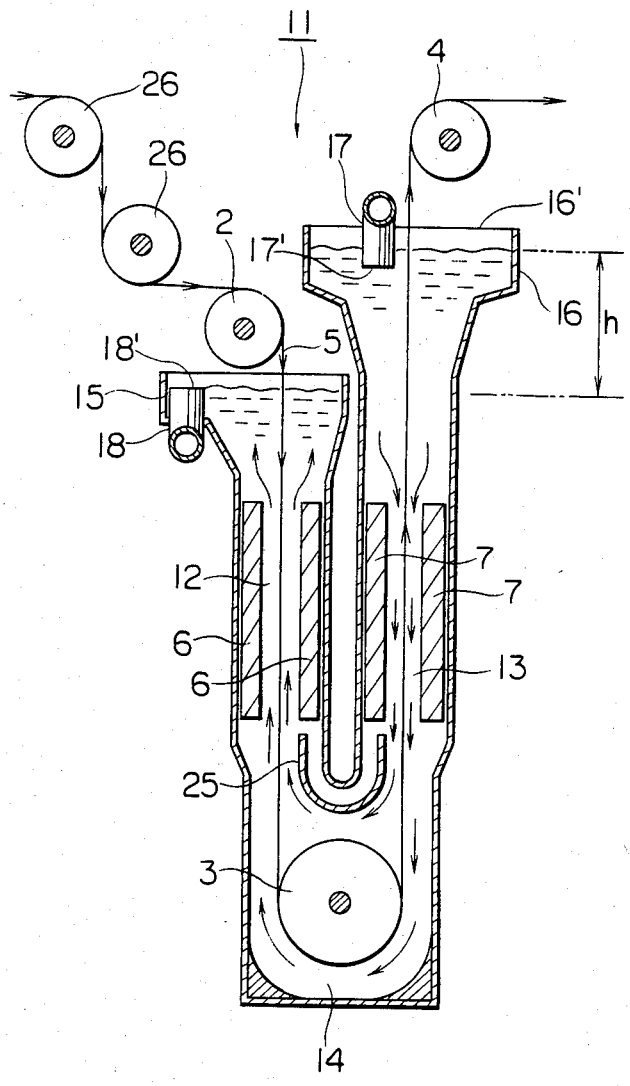
FIG. 3 is a schematic longitudinal sectional view illustrating a second embodiment of the apparatus of the present invention.

FIG. 3 is a schematic longitudinal sectional view illustrating a second embodiment of the apparatus of the present invention. The apparatus of the second embodiment is identical with the apparatus of the above-mentioned first embodiment except that the horizontal path 14 for communicating the lower end of the first vertical path 12 with the lower end of the second vertical path 13 is shorter in length, a single sink roll 3 is arranged in the horizontal path 14, and a U-shaped guide plate 25 for smoothing the flow of the electro-galvanizing bath flowing from the second vertical path 13 through the horizontal path 14 toward the first vertical path 12 is provided above the sink roll 3 in the horizontal path 14. Description is therefore omitted. In FIG. 3, 26 are guide rolls for guiding the steel strip 5 into the vertical type electro-galvanizing tank 11 through the first conductor roll 2.

Figure 4:
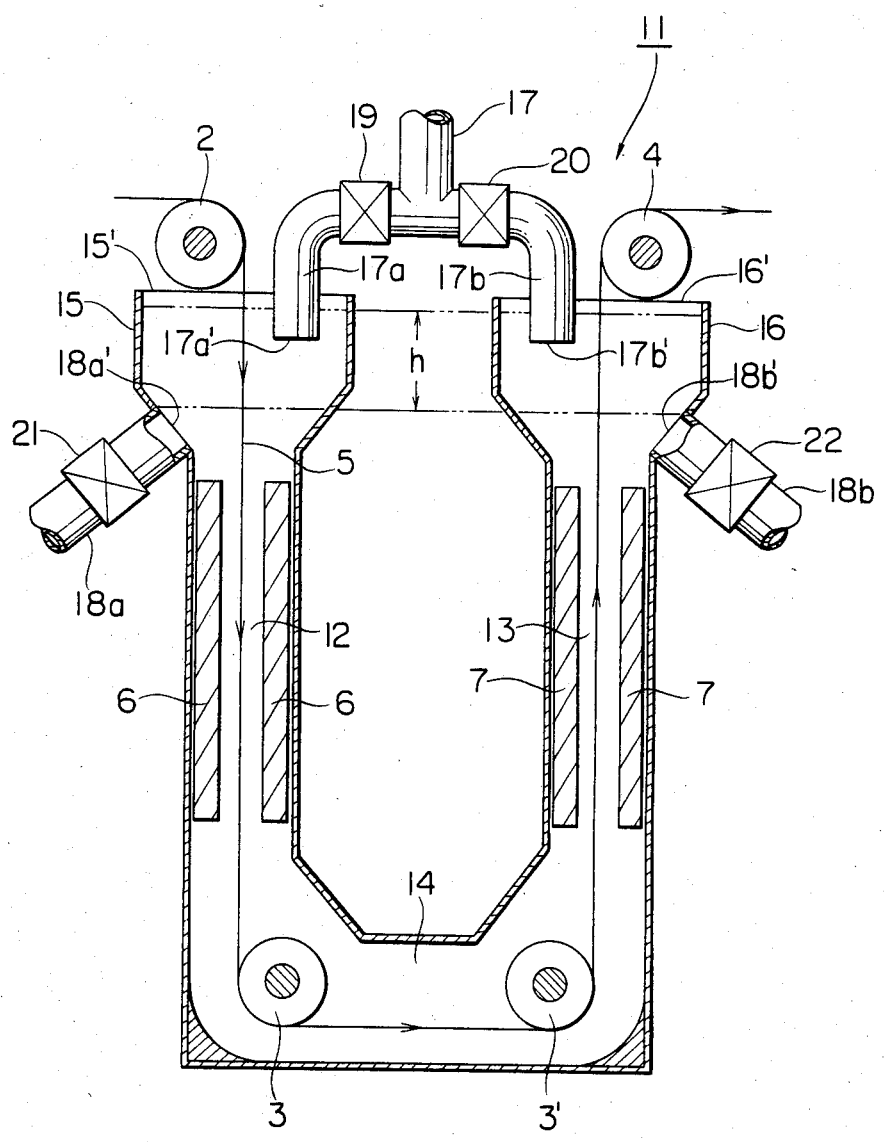
FIG. 4 is a schematic longitudinal sectional view illustrating a third embodiment of the apparatus of the present invention.
Figure 5:
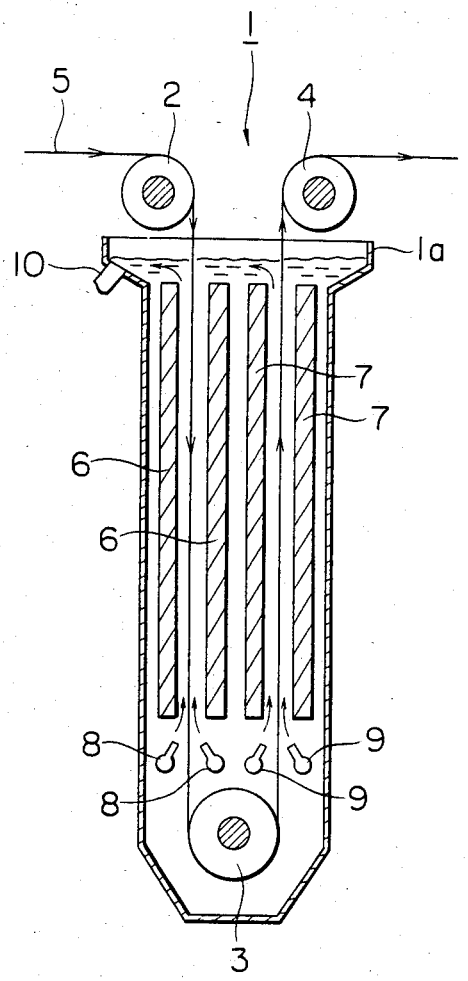
FIG. 5 is a schematic longitudinal sectional view illustrating the conventional apparatus according to the prior art.

FIG. 4 is a schematic longitudinal sectional view illustrating a third embodiment of the apparatus of the present invention. The apparatus of the third embodiment is similar to the apparatus of the first embodiment described above with reference to FIGS. 1 and 2 in that: a vertical type electro-galvanizing tank 11 comprises a U-shaped electro-galvanizing tank including a first vertical path 12, a second vertical path 13 and a horizontal path 14; the first vertical path 12 and the second vertical path 13 have the same cross-sectional area; a first conductor roll 2 is arranged above the first vertical path 12; two sink rolls 3 and 3' are arranged in the horizontal path 14; a second conductor roll 4 is arranged above the second vertical path 13; a pair of first electrode plates 6, 6 are arranged in the first vertical path 12; a pair of second electrode plates 7, 7 are arranged in the second vertical path 13; a top portion 15 of the first vertical path 12 has a cross-sectional area larger than that of the other portion of the first vertical path 12; and a top portion 16 of the second vertical path 13 has a cross-sectional area larger than that of the other portion of the second vertical path 13.

In the apparatus of the third embodiment, an electro-galvanizing solution supply pipe 17 for supplying electro-galvanizing solution into the electro-galvanizing tank 11 to form an electro-galvanizing bath therein branches into a first branch pipe **17*a* having a first valve 19 in the middle thereof and a second branch pipe 17*b* having a second valve 20 in the middle thereof. The first branch pipe 17*a* has an opening end 17*a'* thereof in the top portion 15 of the first vertical path 12, and the second branch pipe 17*b* has an opening end 17*b'* thereof in the top portion 16 of the second vertical path 13**.

In the apparatus of the third embodiment, at least one electro-galvanizing bath discharge means for causing overflow of the electro-galvanizing bath in the electro-galvanizing tank 11 comprises a first electro-galvanizing bath discharge pipe **18*a* having a third valve 21 in the middle thereof, and a second electro-galvanizing bath discharge pipe 18*b* having a fourth valve 22 in the middle thereof. The first electro-galvanizing bath discharge pipe 18 *a* has an opening end 18*a'* thereof in the top portion 15 of the first vertical path 12, and the second electro-galvanizing bath discharge pipe 18*b* has an opening end 18*b'* thereof in the top portion 16 of the second vertical path 13. The opening end 18*a'* of the first electro-galvanizing bath discharge pipe 18*a* is lower in position than the uppermost end 16' of the second vertical path 13, and the opening end 18*b'* of the second electro-galvanizing bath discharge pipe 18*b* is lower in position than the uppermost end 15' of the first vertical path 12**.

Since the apparatus of the third embodiment has a structure as described above, it is possible to easily change the flow direction of the electro-galvanizing bath in the electro-galvanizing tank 11 from the second vertical path 13 through the horizontal path 14 toward the first vertical path 12, or from the first vertical path 12 through the horizontal path 14 toward the second vertical path 13.

More specifically, when supplying an electro-galvanizing solution through the second branch pipe **17*b* into the top portion 16 of the second vertical path 13 to form the flow of the electro-galvanizing bath from the second vertical path 13 through the horizontal path 14 toward the first vertical path 12, the second valve 20 of the second branch pipe 17*b* is opened, the first valve 19 of the first branch pipe 17*a* is closed, the fourth valve 22 of the second electro-galvanizing bath discharge pipe 18*b* is closed, and the third valve 21 of the first electro-galvanizing bath discharge pipe 18*a* is opened. Whereby the electro-galvanizing bath in the electro-galvanizing tank 11 flows sequentially through the second vertical path 13, the horizontal path 14 and the first vertical path 12 under the effect of the head "h" produced between the electro-galvanizing bath level in the top portion 16 of the second vertical path 13 and the electro-galvanizing bath level in the top portion 15 of the first vertical path 12, and overflows through the first electro-galvanizing bath discharge pipe 18*a* provided at the top portion 15 of the first vertical path 12. When the electro-galvanizing bath flows as described above, the lower portion of the second branch pipe 17*b* is immersed into the electro-galvanizing bath in the top portion 16 of the second vertical path 13. The steel strip 5 travels, against the above-mentioned flow direction of the electro-galvanizing bath, sequentially through the first vertical path 12, the horizontal path 14 and the second vertical path 13, and the both surfaces of the steel strip 5 are electro-galvanized while the steel strip 5 passes between the pair of first electrode plates 6, 6 arranged in the first vertical path 12 and between the pair of second electrode plates 7, 7 arranged in the second vertical path 13**.

On the other hand, when supplying an electro-galvanizing solution through the first branch pipe **17*a* into the top portion 15 of the first vertical path 12 to form the flow of the electro-galvanizing bath from the first vertical path 12 through the horizontal path 14 toward the second vertical path 13, the first valve 19 of the first branch pipe 17*a* is opened, the second valve 20 of the second branch pipe 17*b* is closed, the third valve 21 of the first electro-galvanizing bath discharge pipe 18*a* is closed, and the fourth valve 22 of the second electro-galvanizing bath discharge pipe 18*b* is opened. Whereby the electro-galvanizing bath in the electro-galvanizing tank 11 flows sequentially through the first vertical path 12, the horizontal path 14 and the second vertical path 13 under the effect of the head "h" produced between the electro-galvanizing bath level in the top portion 15 of the first vertical path 12 and the electro-galvanizing bath level in the top portion 16 of the second vertical path 13, and overflows through the second electro-galvanizing bath discharge pipe 18*b* provided at the top portion 16 of the second vertical path 13. When the electro-galvanizing bath flows as mentioned above, the lower portion of the first branch pipe 17*a* is immersed into the electro-galvanizing bath in the top portion 15 of the first vertical path 12. The steel strip 5 travels, in the same direction as the above-mentioned flow direction of the electro-galvanizing bath, sequentially through the first vertical path 12, the horizontal path 14 and the second vertical path 13, and the both surfaces of the steel strip 5 are electro-galvanized while the steel strip 5 passes between the pair of first electrode plates 6, 6 arranged in the first vertical path 12 and between the pair of second electrode plates 7, 7 arranged in the second vertical path 13**.

In the apparatus of the third embodiment, as in the apparatus of the first embodiment, the electro-galvanizing bath flows at a uniform flow velocity between the pair of second electrode plates 7, 7 arranged in the second vertical path 13 and the steel strip 5 travelling upwardly and between the pair of first electrode plates 6, 6 arranged in the first vertical path 12 and the steel strip 5 travelling downwardly. It is therefore possible to form coatings free from irregularities and having a uniform chemical composition on the both surfaces of the steel strip 5.

In the apparatus of the third embodiment, as described above, the flow direction of the electro-galvanizing bath in the vertical type electro-galvanizing tank 11 can be easily changed from the second vertical path 13 through the horizontal path 14 toward the first vertical path 12, or from the first vertical path 12 through the horizontal path 14 through the second vertical path 13. Therefore, when the steel strip 5 passes through the vertical type electro-galvanizing tank 11 at a high speed, the flow of the electro-galvanizing bath is formed from the first vertical path 12 through the horizontal path 14 toward the second vertical path 13 in the same direction as the travelling direction of the steel strip 5. This enables to obtain an appropriate relative speed between the electro-galvanizing bath and the steel strip 5, and hence to form coatings having a uniform chemical composition on the both surfaces of the steel strip 5.

In the apparatus of the first to third embodiments described above, the both surfaces of the steel strip 5 are electro-galvanized by applying the pair of first electrode plates 6, 6 and the pair of second electrode plates 7, 7. However, it is needless to say that it is also possible to electro-galvanize only one surface of the steel strip 5, by applying only one of the pair of first electrode plates 6, 6 and only one of the pair of second electrode plates 7, 7, or arranging a single first electrode plate 6 and a single electrode plate 7 respectively in the first vertical path 12 and the second vertical path 13 instead of the pair of first electrode plates 6, 6 and the pair of second electrode plates 7, 7.

Now, the apparatus of the present invention is described more in detail by means of an example.

EXAMPLE

Using the apparatus of the first embodiment as shown in FIGS. 1 and 2, the both surfaces of a steel strip 5 were electro-galvanized under the following conditions:

(1) Chemical composition of the electro-galvanizing bath used:

Zinc sulfate: 150 g/l,
Ferrous sulfate: 350 g/l,
Sodium sulfate: 30 g/l,
Sodium acetate: 15 g/l,
Citric acid: 15 g/l.

(2) Size of the vertical type electro-galvanizing tank 11 used:

Cross section of each of the first vertical path 12 and the second vertical path 13: 2 m×0.22 m, Cross-sectional area of each of the first vertical path 12 and the second vertical path 13: 0.44 $m^2$, Cross-sectional area of the portion excluding the cross-sectional areas of the pair of first electrode plates 6, 6 and the pair of second electrode plates 7, 7 of each of the first vertical path 12 and the second vertical path 13: 0.224 $m^2$.

(3) Electro-galvanizing conditions:

Electro-galvanizing bath temperature: 50° C.,
pH of the electro-galvanizing bath: from 2.0 to 3.0,
Galvanizing current density: from 30 to 60 $A/dm^2$.

An electro-galvanizing solution was supplied at a flow rate of 6.57 $m^3$/minute through the electro-galvanizing solution supply pipe 17 arranged at the top portion 16 of the second vertical path 13 into the top portion 16 of the second vertical path 13 to form an electro-galvanizing bath in the vertical type electro-galvanizing tank 11. The electro-galvanizing bath thus formed, flowed sequentially through the second vertical path 13, the horizontal path 14 and the first vertical path 12 and overflowed through the electro-galvanizing bath discharge pipe 18. On the other hand, the steel strip 5 was travelled, against the flow direction of the electro-galvanizing bath, sequentially through the first vertical path 12, the horizontal path 14 and the second vertical path 13 at a velocity of 67 m/minute through the first conductor roll 2, the sink rolls 3 and 3' and the second conductor roll 4. As a result, the electro-galvanizing bath flowing between the pair of second electrode plates 7, 7 arranged in the second vertical path 13 and the steel strip 5 travelling upwardly and between the pair of first electrode plates 6, 6 arranged in the first vertical path 12 and the steel strip 5 travelling downwardly showed a uniform relative flow velocity of 1.6 m/second against the steel strip 5. Thus, a coating free from irregularities and having a uniform chemical composition, with a coating weight of 40 $g/m^2$ and a ratio of iron content to the coating weight of 18 wt. % was formed on each of the both surfaces of the steel strip 5.

According to the vertical type electro-galvanizing apparatus of the present invention, as described above in detail, it is possible to ensure a uniform flow velocity of an electro-galvanizing bath flowing respectively between at least one first electrode plate arranged in a vertical type electro-galvanizing tank and a steel strip travelling through the tank and between at least one second electrode plate arranged also in the tank and the steel strip to form a coating free from irregularities and having a uniform chemical composition on at least one of the surfaces of the steel strip, thus providing industrially useful effects.

What is claimed is:

1. A vertical type electro-galvanizing apparatus, which comprises:

a vertical type electro-galvanizing tank for receiving an electro-galvanizing bath;

a first conductor roll, arranged above a steel strip inlet side of said electro-galvanizing tank, for substantially vertically directing a steel strip downwardly into said electro-galvanizing tank and applying electricity to said steel strip;

at least one sink roll, arranged in said electro-galvanizing tank, for upwardly reversing the travelling direction of said steel strip directed into said electro-galvanizing tank;

a second conductor roll, arranged above a steel strip outlet side of said electro-galvanizing tank, for substantially vertically directing said steel strip upwardly from said electro-galvanizing tank and applying electricity to said steel strip;

at least one first electrode plate for electro-galvanizing at least one of the surfaces of said steel strip, which is arranged in said electro-galvanizing tank between said first conductor roll and said at least one sink roll substantially in parallel with said steel strip travelling downwardly through said electro-galvanizing tank;

at least one second electrode plate for electro-galvanizing at least one of the surfaces of said steel strip, which is arranged in said electro-galvanizing tank between said at least one sink roll and said second conductor roll substantially in parallel with said steel strip travelling upwardly through said electro-galvanizing tank;

an electro-galvanizing solution supply means for supplying an electro-galvanizing solution into said electro-galvanizing tank to form an electro-galvanizing bath therein, and forming a flow at a prescribed flow velocity of said electro-galvanizing bath between said at least one first electrode plate and said steel strip travelling downwardly and between said at least one second electrode plate and said steel strip travelling upwardly; and at least one electro-galvanizing bath discharge means, provided at a top portion of said electro-galvanizing tank, for causing overflow of said electro-galvanizing bath in said electro-galvanizing tank;

characterized in that:

said vertical type electro-galvanizing tank (11) comprises a U-shaped electro-galvanizing tank including a first vertical path (12) at a steel strip inlet side, a second vertical path (13) at a steel strip outlet side and a horizontal path (14) for communicating the lower end of said first vertical path (12) with the lower end of said second vertical path (13), said first vertical path (12) and said second vertical path (13) having the same cross-sectional area, said steel strip (5) passing sequentially through said first vertical path (12), said horizontal path (14) and said second vertical path (13);

said first conductor roll (2) is arranged above said first vertical path (12);

said at least one sink roll (3, 3') is arranged in said horizontal path (14);

said second conductor roll (4) is arranged above said second vertical path (13);

said at least one first electrode plate (6, 6) is arranged in said first vertical path (12) substantially in parallel with said steel strip (5) travelling downwardly through said first vertical path (12);

said at least one second electrode plate (7, 7) is arranged in said second vertical path (13) substantially in parallel with said steel strip (5) travelling upwardly through said second vertical path (13);

said electro-galvanizing solution supply means comprises an electro-galvanizing solution supply pipe (17) arranged at at least one of a top portion (15) of said first vertical path (12) and a top portion (16) of said second vertical path (13), the lower portion of said electro-galvanizing solution supply pipe (17) being immersed into said electro-galvanizing bath in at least one of said top portions (15, 16) during operation; and said at least one electro-galvanizing bath discharge means comprises at least one electro-galvanizing bath discharge pipe (18) arranged at at least one of said top portion (15) of said first vertical path (12) and said top portion (16) of said second vertical path (13).

2. The apparatus as claimed in claim 1, characterized in that:

said electro-galvanizing solution supply pipe (17) has an opening end (17') thereof in said top portion (16) of said second vertical path (13), and the lower portion of said electro-galvanizing solution supply pipe (17) being immersed into said electro-galvanizing bath in said top portion (16) of said second vertical path (13) during operation;

said at least one electro-galvanizing bath discharge pipe comprises one electro-galvanizing bath discharge pipe (18), said electro-galvanizing bath discharge pipe (18) having an opening end (18') thereof in said top portion (15) of said first vertical path (12), and said opening end (18') of said electro-galvanizing bath discharge pipe (18) being lower in position than the uppermost end (16') of said second vertical path (13);

whereby, said electro-galvanizing bath in said electro-galvanizing tank (11) flows sequentially through said second vertical path (13), said horizontal path (14) and said first vertical path (12) to overflow through said electro-galvanizing bath discharge pipe (18).

3. The apparatus as claimed in claim 1, characterized in that:

said electro-galvanizing solution supply pipe (17) branches into a first branch pipe (**17*a*) having a first valve (19) in the middle thereof and a second branch pipe (17*b*) having a second valve (20) in the middle thereof, said first branch pipe (17*a*) having an opening end (17*a'*) thereof in said top portion (15) of said first vertical path (12), and said second branch pipe (17*b* ) having an opening end (17*b'*) thereof in said top portion (16) of said second vertical path (13**);

said at least one electro-galvanizing bath discharge pipe comprises a first electro-galvanizing bath discharge pipe (**18*a*) having a third valve (21) in the middle thereof and a second electro-galvanizing bath discharge pipe (18*b*) having a fourth valve (22) in the middle thereof, said first electro-galvanizing bath discharge pipe (18*a*) having an opening end (18*a'*) thereof in said top portion (15) of said first vertical path (12), said second electro-galvanizing bath discharge pipe (18*b*) having an opening end (18*b'*) thereof in said top portion (16) of said second vertical path (13), said opening end (18 *a'*) of said first electro-galvanizing bath discharge pipe (18*a*) being lower in position than the uppermost end (16') of said second vertical path (13), and said opening end (18*b'*) of said second electro-galvanizing bath discharge pipe (18*b*) being lower in position than the uppermost end (15') of said first vertical path (12**);

when supplying an electro-galvanizing solution through said second branch pipe (**17*b*) into said electro-galvanizing tank (11), said second valve (20) of said second branch pipe (17*b*) is opened, said first valve (19) of said first branch pipe (17*a*) is closed, said fourth valve (22) of said second electro-galvanizing bath discharge pipe (18*b*) is closed, and said third valve (21) of said first electro-galvanizing bath discharge pipe (18***a*) is opened, whereby said electro-galvanizing bath in said electro-galvanizing tank (11) flows sequentially through said second vertical path (13), said horizontal path (14) and said first vertical path (12) to overflow through said first electro-galvanizing bath discharge pipe (18*a*), and the lower portion of said second branch pipe (17*b*) is immersed into said electro-galvanizing bath in said top portion (16) of said second vertical path (13); and when supplying an electro-galvanizing solution through said first branch pipe (17*a*) into said electro-galvanizing tank (11), said first valve (19) of said first branch pipe (17*a*) is opened, said second valve (20) of said second branch pipe (17*b*) is closed, said third valve (21) of said first electro-galvanizing bath discharge pipe (18*a*) is closed, and said fourth valve (22) of said second electro-galvanizing bath discharge pipe (18*b*) is opened, whereby said electro-galvanizing bath in said electro-galvanizing tank (11) flows sequentially through said first vertical path (12), said horizontal path (14) and said second vertical path (13) to overflow through said second electro-galvanizing bath discharge pipe (18*b*), and the lower portion of said first branch pipe (17*a*) is immersed into said electro-galvanizing bath in said top portion (15) of said first vertical path (12).

* * * * *